United States Patent [19]

Jendrusch

[11] 4,433,773

[45] Feb. 28, 1984

[54] APPARATUS FOR MANIPULATING STACKS OF PAPER SHEETS OR THE LIKE

[75] Inventor: Paul Jendrusch, Hamburg, Fed. Rep. of Germany

[73] Assignee: E.C.H. Will (GmbH & Co.), Hamburg, Fed. Rep. of Germany

[21] Appl. No.: 337,426

[22] Filed: Jan. 6, 1982

[30] Foreign Application Priority Data

Jan. 10, 1981 [DE] Fed. Rep. of Germany ..... 3100583

[51] Int. Cl.[3] ..... B65G 37/00

[52] U.S. Cl. ..... 198/467; 198/485; 271/184; 271/225

[58] Field of Search ..... 198/457, 485, 465, 469, 198/470, 467; 271/184, 225, 84, 267, 269

[56] References Cited

U.S. PATENT DOCUMENTS

| | | | |
|---|---|---|---|
| 2,141,212 | 12/1938 | Kimball et al. | 198/457 |
| 3,522,942 | 12/1967 | Hepp | 198/469 |
| 4,167,994 | 9/1979 | Seragnoli | 198/457 |
| 4,296,684 | 10/1981 | Wangermann | 271/84 |

FOREIGN PATENT DOCUMENTS

| | | | |
|---|---|---|---|
| 1192978 | 5/1965 | Fed. Rep. of Germany | 198/485 |

*Primary Examiner*—Joseph E. Valenza
*Assistant Examiner*—Kyle E. Shane
*Attorney, Agent, or Firm*—Kontler, Grimes & Battersby

[57] ABSTRACT

Successive stacks of flexible paper sheets are supplied by the conveyors of a feeding unit in a first direction and along a first horizontal path onto a succession of vertically movable sections of a horizontal table while the sections dwell in their upper positions. The sections are thereupon lowered simultaneously to the level of a second horizontal path wherein a pusher advances the lowered stack in a second direction at right angles to the first direction and along the second horizontal path into the range of two belt conveyors forming part of a removing unit. The sections of the table are disposed one behind the other, as considered in the second direction, and are raised individually back to their upper positions as soon as the pusher advances an article therebeyond. A supporting member assists the sections in supporting an oncoming article in the first path during advancement of such article to a position above the sections of the table.

18 Claims, 8 Drawing Figures

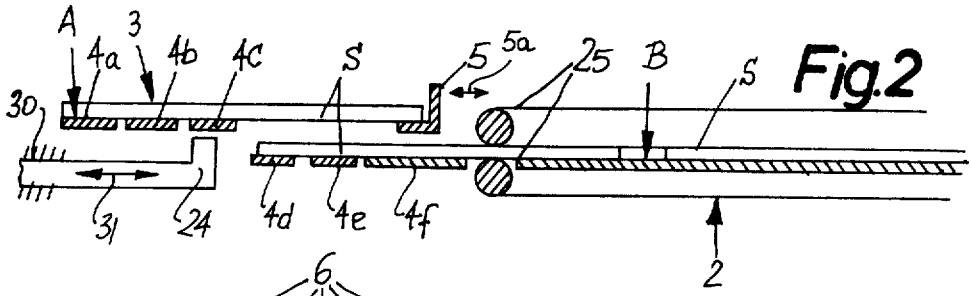
Fig.2
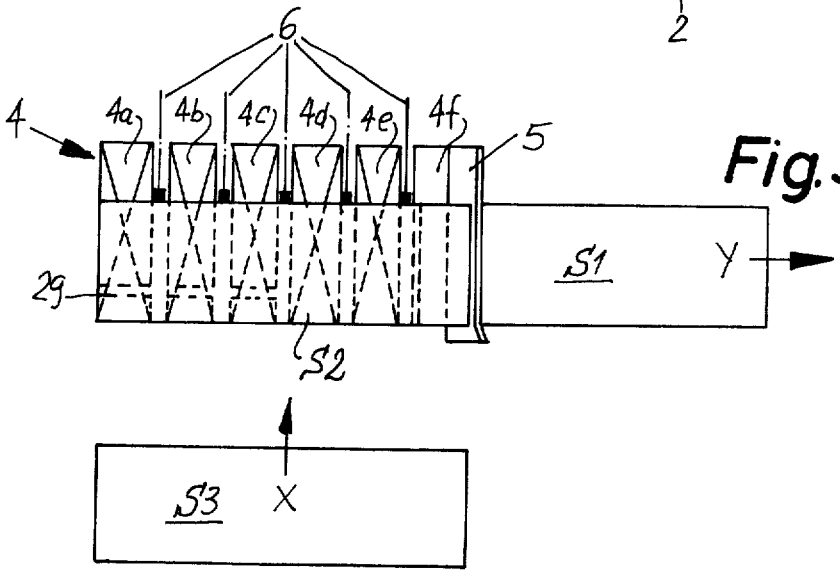
Fig.3
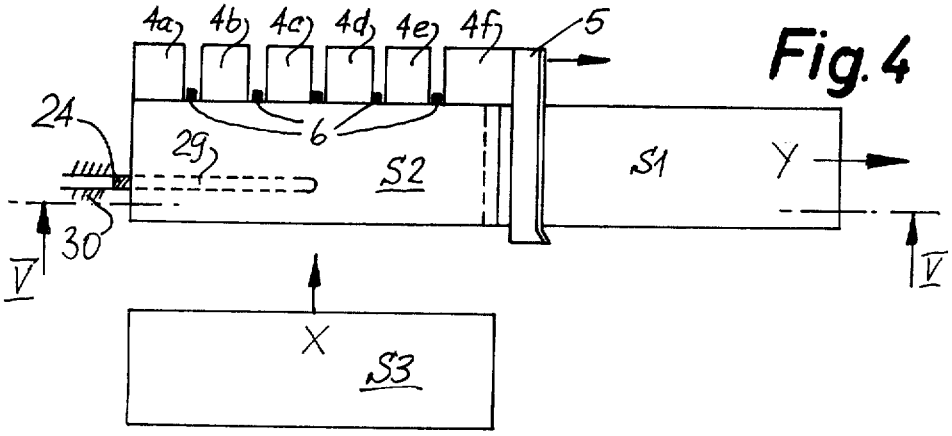
Fig.4
Fig.5
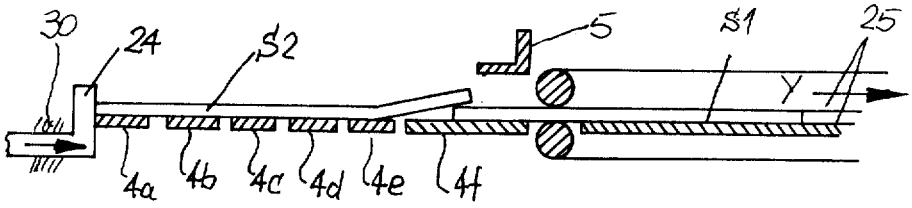

APPARATUS FOR MANIPULATING STACKS OF PAPER SHEETS OR THE LIKE

BACKGROUND OF THE INVENTION

The present invention relates to improvements in apparatus for manipulating block-shaped commodities or articles in the form of paper stacks or the like. More particularly, the invention relates to improvements in apparatus for changing the direction of travel of a series of rapidly moving and closely adjacent articles, especially flat articles which are flexible, i.e., which can retain their shape only if supported along their entire undersides.

It is known to transport stacks of paper sheets or analogous flexible articles in a first plane and in a first direction by resorting to a feeding unit, to transport successive articles in a second plane and in a different second direction by resort to a removing unit, and to provide a transfer unit which delivers successive articles from the first into the second plane. Reference may be had to German Auslegeschrift No. 11 92 978 which discloses an apparatus for transport of block-shaped articles first along a first path and thereupon along a second path in a direction at right angles to the direction of transport along the first path. The articles are supplied in the form of a file or row wherein the articles are rather closely adjacent to each other, and the transfer from the first path into the second path (which is located at a level above the first path) takes place by resorting to a pusher which lifts successive articles from the first path and into the range of hook-shaped retaining members which engage one side of the lifted article to thus retain the article in the second path while the pusher returns to a level below the first path so as to be ready for the lifting of the next-following article. The articles which reach the second path are engaged by a horizontally reciprocable shifting device which removes them from the hook-shaped retaining members so that such members are then ready to engage the next-following article.

A drawback of the just described conventional apparatus is that it cannot treat all types of flat block-shaped articles, especially articles which exhibit a low resistance to deformation. Thus, whereas the conventional apparatus can readily transport bricks or similar non-deformable block-shaped articles, it cannot transport or manipulate stacks of overlapping paper sheets or like commodities which do not offer a pronounced resistance to deformation and are especially likely to undergo deformation while held by the aforementioned hook-shaped retaining members. Were a stack of paper sheets supported by such retaining members, it would exhibit a strong tendency to flex and to thereby become disengaged from the retaining members.

As a rule, flexible articles (such as stacks of paper sheets) must be supported along their entire undersides so as to prevent any or to prevent undue deformation during a change of direction of movement and/or from a path which is located at a first level into a path which is located at a different second level. Flexible articles are often manipulated by resort to a rotary conveyor in the form of a turret having radially extending compartments for discrete stacks. The turret is rotatable stepwise about an axis which is parallel to the direction of movement of the feeding unit. Successive compartments of the turret receive successive stacks from the feeding conveyor during successive intervals of dwell of the turret. At the same time, the stack which occupies the preceding compartment is removed from the turret by resorting to tongs or a similar implement. The mass of the turret is quite substantial; therefore, the turret cannot be indexed at frequent intervals, i.e., the number of articles which can be transferred per unit of time is limited by the bulk and inertia of the turret. Another drawback of such apparatus is that the articles which are ready for removal from the turret are not disposed in a horizontal plane. This presents problems in connection with further transport of articles to the next processing station or to another destination.

OBJECTS AND SUMMARY OF THE INVENTION

An object of the invention is to provide a novel and improved apparatus which can be used for manipulation of rigid and/or deformable block-shaped articles, which can process the articles at frequent intervals, and which can convert the delivered articles into a file of closely adjacent or spaced-apart articles.

Another object of the invention is to provide a novel and improved apparatus which can be used with particular advantage for the processing of flexible block-shaped commodities, such as stacks of paper sheets or the like.

A further object of the invention is to provide the apparatus with novel and improved means for transferring successive articles of a short or long series of articles from a first plane into a second plane with simultaneous change in the direction of transport of the articles.

An additional object of the invention is to provide the apparatus with novel and improved means for supporting from below flexible articles during transfer between the aforementioned planes.

Another object of the invention is to provide an apparatus of the above outlined character which can be installed in existing production lines for the making of stacks of paper sheets or the like.

A further object of the invention is to provide the apparatus with novel and improved means for ensuring proper orientation of successively delivered articles during transfer from the first plane into the second plane, for example, from a first horizontal path at a first level into a second horizontal path at a second level below the first level.

An ancillary object of the invention is to provide novel and improved means for regulating the movements of component parts of the transfer unit in an apparatus of the above outlined character.

The improved apparatus serves to manipulate a series of preferably closely adjacent flat articles, such as flexible stacks of paper sheets, and comprises a feeding unit including first conveyor means (e.g., a pair of superimposed elongated endless belts) for advancing the articles of the series in a first direction and along a first (preferably horizontal) path, a removing unit including second conveyor means for advancing successive articles of the series in a second direction (preferably at right angles to the first direction) and along a second (preferably horizontal) path, and a third unit which constitutes a means for transferring successive articles of the series from the first path into the second path. The transferring means includes a table or platform having a succession of sections disposed one behind the other, as considered in the second direction, and movable between upper positions in which they are located at the level of the first path and support from below an article which is supplied by the conveyor means of the feeding unit and lower positions in which the article thereon is located at the level of the second path, means for moving the sections including means for simultaneously lowering the sections from the first to the second positions and for individually lifting the sections of the aforementioned succession from the lower to the upper positions as soon as (preferably immediately after) an article which is supported by the sections during movement of sections to their lower positions is advanced along the second path and beyond a section, and means (such as a substantially L-shaped bracket or an analogous element) for temporarily supporting portions of successive articles in the first path during advancement of such articles into the range of the movable sections (i.e., to a level above the movable sections). The apparatus preferably further comprises means (such as a crank or a cam drive) for disengaging the supporting means from an article in the first path not later than during simultaneous movement of the sections to their lower positions.

The apparatus preferably further comprises means for directly or indirectly guiding the sections during movement between their upper and lower positions. Such means for guiding can comprise reciprocable guide rods movable in one or more stationary bearings and having upper end portions connected with holders for the respective sections of the table.

The moving means can comprise a discrete cam (e.g., a rotary cam) for each of the sections and/or a discrete motor (such as a fluid-operated motor, especially a pneumatic cylinder and piston unit) for each movable section.

The moving means preferably further comprises discrete sensors (e.g., mechanical switches), one for each of the movable sections and each arranged to generate signals denoting the presence and/or absence of an article on top of the respective section. The lifting means of the moving means then comprises devices (e.g., the aforementioned motors) which are actuatable in response to signals from the sensors to move a section back to its upper position when the signal from the respective sensor indicates that the article, which has been lowered by the sections of the table, is advanced beyond the corresponding section.

The removing unit preferably further comprises means (such as a reciprocable pusher or finger) for transporting successive articles from the sections of the table into the range of the second conveyor means. The finger is movable in the second direction by a cam or crank drive and at least some sections of the table are preferably provided with aligned slots for the finger. The latter can be reciprocated back and forth in and counter to the second direction.

The second conveyor means preferably comprises a pair of endless flexible belts or chains having portions which are immediately adjacent to the table, and the second path is preferably defined by and located between the two belts.

The apparatus preferably further comprises stop means provided in the region of the table and serving to arrest successive articles supplied by the feeding unit in predetermined positions with reference to movable sections of the table. Such stop means can comprise a series of discrete stops or a continuous stop extending at least substantially transversely of the first direction (i.e., transversely of the first path). Still further, the apparatus preferably comprises mobile orientation correcting means which is adjacent to the first path and serves to urge (if necessary) successive articles of the series against the stop means to thus ensure that each article assumes the aforementioned predetermined position prior to movement of sections to their lower positions. The orientation correcting means can comprise a member (e.g., a lever with a pallet which can engage the rear end faces of successive articles in the form of stacks of superimposed paper sheets or the like) which is pivotable about a predetermined axis, preferably about an axis which is normal to the first direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a sectional view as seen in the direction of arrows from the line II—II of FIG. 1;

FIG. 3 is a plan view of the transfer unit of the apparatus, showing all mobile sections of the table in their upper end positions in which the sections support a freshly supplied article, the preceding article being supported and advanced by the removing unit of the apparatus;

FIG. 4 is a similar plan view but showing the mobile sections of the table in their lower end positions in which the underside of the freshly supplied article is located at the level of the path which is defined by the removing unit;

FIG. 5 is a vertical sectional view as seen in the direction of arrows from the line V—V of FIG. 4;

DESCRIPTION OF THE PREFERRED EMBODIMENTS

Figure 1:
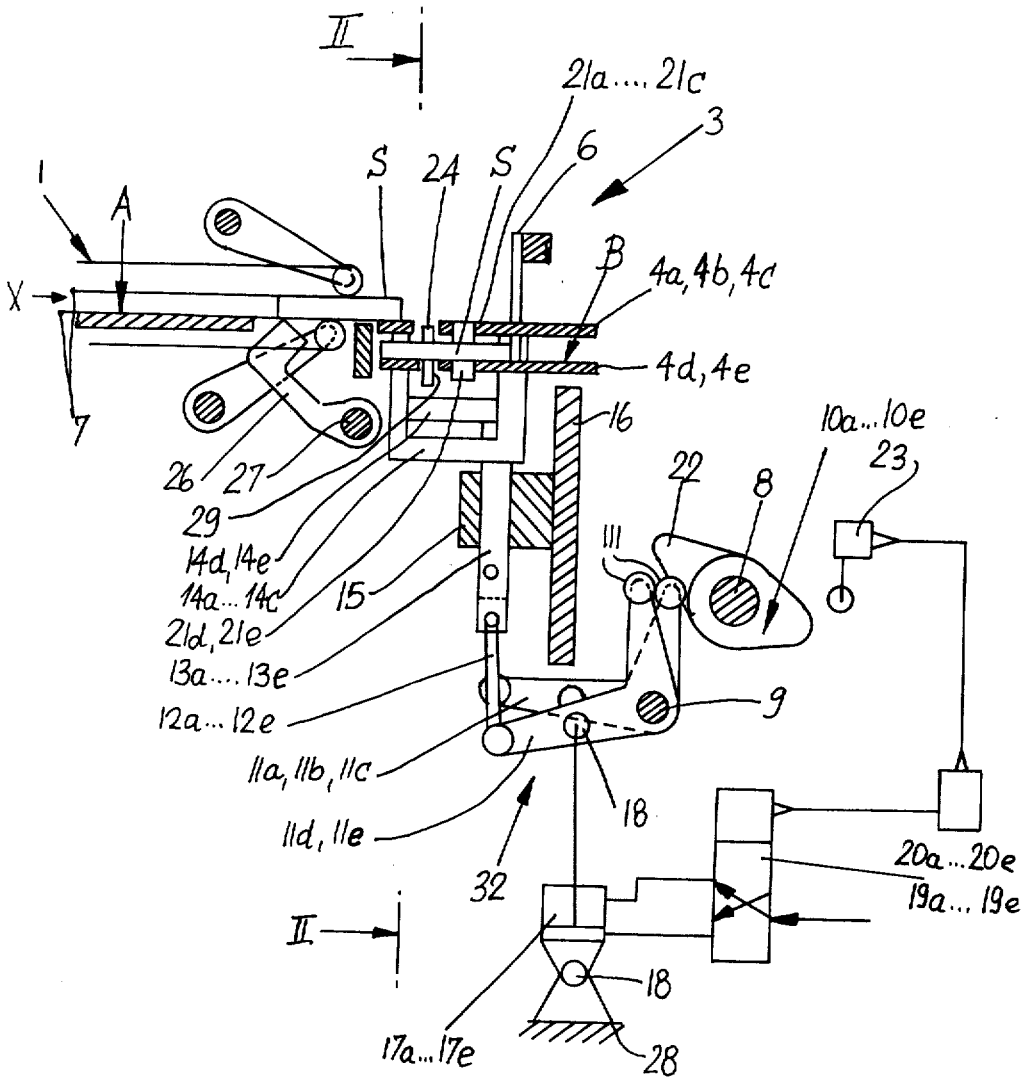
FIG. 1 is a vertical sectional view of an apparatus which embodies the invention and is designed to transport stacks of paper sheets or analogous articles, the section being taken in a plane which is parallel to the direction of delivery of successive articles by the feeding unit of the apparatus.

The apparatus which is shown in the drawing comprises an article feeding unit 1, an article removing unit 2 and a transfer unit or transferring means 3 which delivers articles S (such as block-shaped elongated flexible stacks of superimposed paper sheets) from a first horizontal path A defined by the unit 1 into a second horizontal path defined by the unit 2. The (first) direction X in which the unit 1 feeds articles S into the range of the transfer unit 3 makes an angle of 90 degrees with the (second) direction Y of removal of articles S by the unit 2. The path B is located at a level below the path A, and the distance between such paths at least equals the height of an article S.

The feeding unit 1 comprises two elongated belt conveyors 7 which deliver successive articles S in such a way that the upper side of an oncoming article S is engaged by the lower reach of the upper conveyor 7 while the underside of the article is simultaneously engaged by the upper reach of the lower conveyor 7. The removing unit 2 also comprises two endless elongated belt conveyors 25 which engage and remove successive articles S in such a way that the upper side of an article S is engaged by the lower reach of the upper conveyor 25 while the underside of the same article is simultaneously engaged by the upper reach of the lower conveyor 25. Thus, the upper reach of the lower conveyor 7 defines the path A, and the upper reach of the lower conveyor 25 defines the path B.

The transfer unit 3 comprises a table or platform 4 (see particularly FIG. 3) including five sections or portions 4*a*, 4*b*, 4*c*, 4*d* and 4*e* which are movable up and down between the levels of the paths A and B, and a stationary section 4*f* whose upper side is located at the level of the path B. The sections 4*a* to 4*f* of the table 4 are located one behind the other, as considered in the direction (arrow Y) of advancement of articles S with the belts 25 of the removing unit 2. Those mobile sections of the table 4 which are located at the level of the path A are denoted by diagonal crosses (note the sections 4*a* to 4*e* of FIG. 3, the sections 4*a* and 4*b* of FIG. 6, the sections 4*a* to 4*c* of FIG. 7 and the sections 4*a* to 4*d* of FIG. 8). The stationary section 4*f* of the table 4 is disposed between the last reciprocable section 4*e* and the receiving ends of the conveyors 25 forming part of the removing unit 2.

The removing unit 2 further comprises a transporting pusher or finger 24 which is reciprocable in directions indicated by a double-headed arrow 31. The means 32 for moving the sections 4*a* to 4*e* of the table 4 between their upper and lower positions comprises a camshaft 8 whose end portions are mounted in the frame of the improved apparatus (such frame includes a crosshead 16 which is shown in FIG. 1) and which is driven by the main prime mover (e.g., an electric motor, not shown) of the apparatus or of the machine or production line which embodies the improved apparatus. The main prime mover further drives the belt conveyors 7 and 25 of the units 1, 2 and the transporting finger 24.

During each revolution of the camshaft 8, the belt conveyors 7 of the feeding unit 1 receive a fresh article S from the non-illustrated arrangement which makes or assembles the articles S, and the conveyors 7 also deliver an article S to the transfer unit 3 during each revolution of the shaft 8. The conveyors 7 and 25 are driven by way of suitable transmissions, not shown, whose ratio determines the spacing between successive articles S, i.e., the width of the clearances or gaps between successive articles. The transmission ratios will be selected, in part, in dependency on the dimensions of the articles S, i.e., on their length (the unit 2 advances the articles S lengthwise) and on their width (the unit 1 advances the articles S sideways).

The moving means 32 further comprises a discrete lever 11*a* to 11*e* for each of the movable table sections 4*a* to 4*e*. The levers 11*a* to 11*e* are bell crank levers which are pivotable on a horizontal shaft 9 mounted in the aforementioned frame of the apparatus and extending in parallelism with the camshaft 8. The left-hand arms of the levers 11*a* to 11*e*, as viewed in FIG. 1, are respectively coupled to connecting rods 12*a* to 12*e* which, in turn, are articulately connected to lower end portions of vertically reciprocable guide rods 13*a* to 13*e* mounted in suitable bearings 15 on the crosshead 16. The right-hand (upwardly extending) arms of the bell crank levers 11*a* to 11*e* are provided with roller followers 111 which track the peripheral surfaces of discrete disc-shaped face cams 10*a* to 10*e* on the camshaft 8.

The guide rods 13 are held against rotation in the respective bearings 15, e.g., as a result of the provision of tongues which extend into complementary vertical grooves in the corresponding bearings.

The levers 11*a* to 11*e* are further pivotable about the axis of the common shaft 9 by discrete fluid-operated (hydraulic or pneumatic) motors 17*a* to 17*e* in the form of double-acting cylinder and piston units whose cylinders are articulately connected with a frame member 28 by joints 18 and whose piston rods are articulately connected with the respective levers 11*a* to 11*e* by similar or analogous joints 18. The chambers of the cylinders forming part of the motors 17*a* to 17*e* can receive or discharge pressurized fluid by way of discrete solenoid-operated valves 19*a* to 19*e* which are controlled by relays 20*a* to 20*e*. The relays 20*a* to 20*e* respectively receive signals from sensors 21*a* to 21*e* which are respectively associated with the mobile sections 4*a* to 4*e* of the table 4. Each of the sensors 21*a* to 21*e* can constitute a conventional mechanical contact switch which is mounted in or on the respective section of the table 4. A disc-shaped cam 22 on the camshaft 8 serves to actuate a switch 23 which then transmits a signal to all of the relays 20*a*–20*e* in order to change the condition of the respective motors 17*a* to 17*e*.

The sections 4*a* to 4*e* of the table 4 are mounted on holders 14*a* to 14*e* which, in turn, are mounted on the guide rods 13*a* to 13*e*. At least some of the sections 4*a* to 4*e* are formed with aligned slots 29 which are wide enough to allow for reciprocation of the transporting finger 24 in directions indicated by the arrow 31. The finger 24 is reciprocable in a fixed bearing 30 and receives motion from the aforementioned main prime mover by way of a suitable crank or cam drive (not shown). The bearing 30 is mounted in or on the aforementioned frame which includes the member 28 and the crosshead 16.

The apparatus further comprises adjustable stops 6 located in the path of movement of successive articles S which are advanced by the conveyors 7 of the feeding unit 1 to arrest an oncoming article S in a predetermined position in which such article is ready to be lowered into the path B. The stops 6 cooperate with an orientation changing or correcting member in the form of a lever 26 which is pivotable about the axis of a horizontal shaft 27 mounted in the frame of the apparatus.

The operation is as follows:

The movable sections 4*a* to 4*e* of the table 4 are assumed to be held in the upper positions shown in FIG. 3, i.e., the upper sides of these sections are then located at the level of the horizontal path A. The conveyors 7 are in the process of delivering a fresh article S2 which is a stack of overlapping paper sheets or analogous flexible elements. The article S2 is delivered by moving upwardly, as viewed in FIG. 3, and comes to rest on the upper sides of the movable sections 4*a* to 4*e* as well as on the horizontal leg of an L-shaped supporting member 5 which is movable to and from the operative position of FIG. 2, e.g., by a mechanism which is indicated by the arrow 5*a* and which can move the supporting member 5 toward and away from the receiving end of the removing unit 2. The front end face of the article S2 comes into abutment with the stops 6 and the rear end face of such article is engaged by the pallet of the lever 26 to ensure optimum orientation of the article S2 prior to transfer from the path A into the path B. The moving means 32 then begins to simultaneously lower the sections 4*a* to 4*e* by way of the cams 10*a* to 10*e*, levers 11*a* to 11*e*, connecting rods 12*a* to 12*e*, guide rods 13*a* to 13*e* and holders 14*a* to 14*e*. The movements of the sections 4*a* to 4*e* are terminated when their upper sides reach the level of the path B. The supporting member 5 is shifted away from the article S2 and the orientation correcting member 26 is pivoted away from such article before the sections 4*a* to 4*e* begin to descend or not later than during the initial stage of downward movement of the sections 4*a* to 4*e*. The supporting member 5 and/or the orientation correcting member 26 can receive motion from the camshaft 8 by way of suitable cams on the camshaft and links which are connected to the parts 5, 26 and have followers tracking the corresponding cams on the shaft 8. Such cams and links are not specifically shown because they are standard components of many paper processing machines.

The member 5 is adjacent to the removing unit 2 in the region of and above the fixed table section 4*f*.

When the sections 4*a* to 4*e* reach the level of the path B, the cam 22 actuates the switch 23 which energizes the relays 20*a* to 20*e* so that the relays cause the respective valves 19*a* to 19*e* to maintain the motors 17*a* to 17*e* in positions in which the piston rods of the motors pull all of the sections 4*a* to 4*e* to their lower end positions, i.e., the upper sides of the sections 4*a* to 4*e* are held in the plane of the path B. To this end, the relays 20*a* to 20*e* comprise suitable holding circuits which maintain these relays in energized condition. The holding circuits of the relays 20*a* to 20*e* can be opened by the corresponding sensors 21*a* to 21*e*. It will be noted that the motors 17*a* to 17*e* take over to maintain the sections 4*a* to 4*e* in their lower end positions when the cams 10*a* to 10*e* are no more capable of performing such task, i.e., when the followers 111 of the levers 11*a* to 11*e* track such portions of the respective cams which would enable suitable springs (not specifically shown) to lift the sections 4*a* to 4*e* back to the upper positions of FIG. 3.

When the article S2 descends into the plane of the path B, its rear end face is immediately engaged by the finger 24 which moves along the slot 29 and transports the article S2 lengthwise with reference to the sections 4*a* to 4*f* and into the space between the upper and lower conveyors 25 of the removing unit 2. The conveyors 25 then entrain the article S2 and advance it beyond the sections 4*a* to 4*f*, i.e., in a direction (arrow Y) to the right, as viewed in FIGS. 2 to 8.

When the rear portion of the article S2 advances beyond the movable section 4*a*, the sensor 21*a* is caused to actuate the corresponding motor 17*a* via relay 20*a* and valve 19*a* so that the section 4*a* returns to its upper position. Such movement of the section 4*a* is followed by upward movement of the section 4*b* as soon as the sensor 21*b* is capable of actuating the valve 19*b* via relay 20*b*. The sections 4*a*, 4*b* are followed by the sections 4*c*, 4*d* and 4*e* (note FIGS. 6, 7 and 8) so that all of the movable sections return to their upper positions and are ready to support a fresh article S3 as soon as the trailing end of the article S2 advances beyond the sensors 21*a*, 21*b*, 21*c*, 21*d* and 21*e* in such order. The arrangement is preferably such that the normally lightweight sections 4*a* to 4*e* are lifted practically instantaneously in immediate response to signals from the associated sensors 21*a* to 21*e*.

Figure 6:
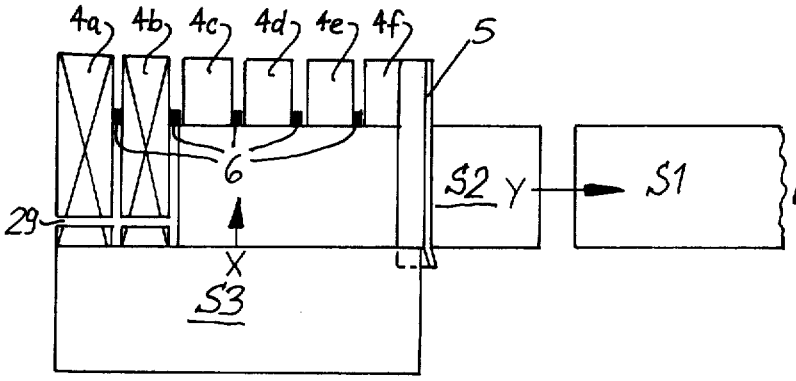
FIG. 6 is another plan view of the transfer unit, showing the freshly supplied article during removal from the upper sides of the mobile sections of the table, with two mobile sections already back in their upper or raised positions ready to support an oncoming additional article.

The supporting member 5 is returned to its operative position immediately after the previously supplied article S2 descends to the level of the path B so that the horizontal leg of the member 5 is ready to support the adjacent side of the next article S3 which is supplied by the conveyors 7 of the feeding unit 1. As can be seen in FIG. 5, the leader of the article S2 can be deposited onto the trailing end of the preceding article S1. The speed of the conveyors 25 can be readily selected in such a way that the preceding article S1 is advanced forwardly and away from the leader of the article S2 before the finger 24 advances through a distance which is needed to place the leader of the article S2 into the left-hand end of the space between the conveyors 25 of the removing unit 2, i.e., before the conveyors 25 actually engage and entrain the article S2. The next-following article S3 can readily advance above the article S2 while the latter is still supported by some of the movable sections 4*a* to 4*e*. As shown in FIG. 6, the article S3 is about to reach the range of the transfer unit 3 when the sections 4*a* and 4*b* are already returned to their upper positions so that the article S3 can be supported by the sections 4*a*, 4*b* and the horizontal leg of the supporting member 5. As the article S3 continues to advance upwardly, as viewed in FIGS. 6 to 8, the sections 4*c*, 4*d* and 4*e* also return to their upper positions so that such article is supported by five movable sections 4*a* to 4*e* as well as by the horizontal leg of the supporting member 5 before the latter is moved out of the way and the sections 4*a* to 4*e* descend to move the article S3 from the path A into the path B.

The feature which is shown in FIG. 5 renders it possible to form on the lower conveyor 25 an at least substantially uninterrupted file or row of successive articles S1, S2, S3, etc. by the simple expedient of causing the leader of a next-following article (such as S2) to overlie the trailing end of the preceding article (S1) and by causing the finger 24 to advance with a requisite delay so that the leader of the article S2 is engaged by the conveyors 25 immediately behind the trailing end of the article S1. It goes without saying that the just described parts also permit for the formation of a file wherein successive articles are separated from each other by clearances or gaps of preselected width.

If desired, the finger 24 can be replaced by a transporting element in the form of tongs which is reciprocable in the longitudinal direction of the conveyors 25 and serves to transfer successive articles from the upper sides of the sections 4*a* to 4*f* into the range of the removing unit 2. If the finger 24 is replaced with a tongs, the movable sections 4*a* to 4*e* are caused to descend (simultaneously) only after the tongs has completed the transfer of a previously delivered article into the removing unit 2, i.e., when the entire previously delivered article is out of the way to thus permit the descent of the next-following article without any overlap between such article and the preceding article.

It is further within the purview of the invention to modify the design of the mechanism which moves the supporting member 5. For example, the supporting member 5 can be moved downwardly with the sections 4*a* to 4*e*, thereupon in a direction to the right, as viewed in FIGS. 2 or 5, and thereupon upwardly back to the position shown in FIG. 2.

An important advantage of the improved apparatus is that the mass of individual sections 4*a* to 4*e* of the table 4 is or can be small or even very small so that such sections can be rapidly moved from the upper positions of FIG. 3 to the lower positions of FIG. 4 and back to the upper positions. As explained above, the sections 4*a* to 4*e* descend simultaneously from the upper to the lower positions but move individually from the lower to the upper positions as soon as the transporting finger 24 advances an article beyond the upper side of a section.

Another important advantage of the improved apparatus is that it can be used, with equal advantage, for the manipulation of rigid or stiff articles as well as for the manipulation of pliable articles, such as the illustrated stacks S of superimposed paper sheets or the like. The stacks remain horizontal during advancement to the positions above the raised mobile sections of the table 4, during simultaneous movement of sections 4*a* to 4*e* to their lower positions, as well as during transport of the stacks by the finger 24 of the removing unit 2. The left-hand portions of the conveyors 25 of the removing unit 2 (as viewed in FIG. 2) are preferably placed into close or immediate proximity of the table 4 to thus ensure that the finger 24 can rapidly advance the leader of an article from a position above the fixed section 4*f* of the table 4 into the receiving end of the slot between the conveyors 25. The space above the sections 4*a* to 4*f* (in the plane of the path A) is available for reception of an oncoming article (such as the article S3 shown in FIGS. 6 to 8) immediately after the sections 4*a* to 4*e* simultaneously descend to the lower positions shown in FIGS. 4 and 5. This renders it possible to proceed with advancement of the article S3 toward a position of full overlap with the sections 4*a* to 4*f* while the preceding article S2 is still in the process of being transported (by the finger 24 and thereupon by the conveyors 25) from the space immediately above the fixed section 4*f* of the table. During transport of a lowered article (such as S2) by the finger 24 and thereupon by the conveyors 25, the oncoming article S3 is supported by at least one movable section (such as 4*a*) and by the horizontal leg of the supporting member 5. The number of supports for the underside of the oncoming article S3 increases progressively as the sections 4*b*, 4*c*, 4*d* and 4*e* return to their upper positions, one after the other and as soon as the finger 24 and/or the conveyors 25 have completed the advancement of the trailing end of the preceding article S2 beyond the respective sensors 21*a*, 21*b*, 21*c*, 21*d* and 21*e* (in such order). It will be noted that the combined area of the composite support (4*a*–4*e* and 5) for the underside of an oncoming article S3 increases progressively and proportionally with the extent to which the oncoming article advances toward the stops 6 which form a row of discrete stops extending transversely of the direction indicated by the arrow X, i.e., transversely of the direction of advancement of successive articles along the path A. It will also be noted that, in the illustrated apparatus, the directions which are indicated by the arrows X and Y make an angle of 90 degrees. The feature that an article can enter the transfer unit 3 while the preceding article is in the process of being removed from the transfer unit contributes to higher output of the apparatus and renders it possible to assemble the removed articles into a row wherein the neighboring articles are immediately or closely adjacent to each other.

The provision of sensors 21*a* to 21*e* is desirable and advantageous because the apparatus operates properly irrespective of the dimensions of the articles. The articles can constitute stacks of paper sheets arriving from the cutting station of a production line wherein large sheets of paper are converted into wrapped and packed or crated stacks. As a rule, the arrangement is such that the articles which advance along the path A move sideways (see the arrows X) and that the articles which advance along the path B move lengthwise (see the arrows Y). The number of movable table sections will depend on the dimensions of the articles and on the flexibility of each article.

Figure 7:
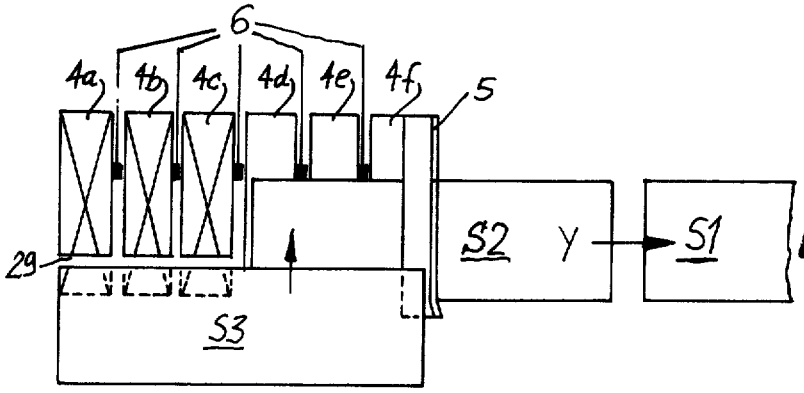
FIG. 7 is a similar plan view but showing three mobile sections in raised positions.
Figure 8:
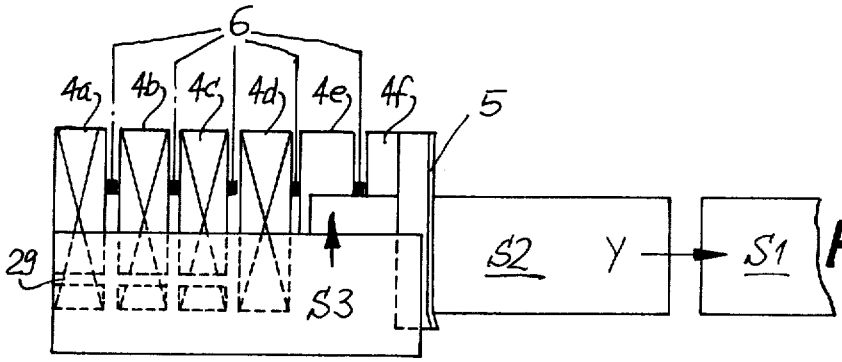
FIG. 8 is a similar plan view but showing four of the five mobile sections in raised positions.

The transporting finger 24 not only advances successive articles from the transfer unit 3 into the removing unit 2 but it also serves to orient such articles during transport along the upper sides of movable sections 4*a* to 4*e* while such sections dwell in their lower positions. The stroke of the transporting finger 24 need not match the length of an article (as considered in the direction of arrows Y) because the conveyors 25 of the removing unit 2 are preferably placed into close or immediate proximity of the table 4 so that the conveyors 25 can engage and entrain a freshly lowered article S after a relatively short forward movement of the finger 24. Therefore, it suffices to provide slots 29 only in some of the mobile sections 4*a* to 4*c* (FIGS. 7 and 8 show that such slots are provided in the sections 4*a* to 4*c*).

The stop or stops 6 perform a desirable and important function, namely, to arrest successive articles which are normally delivered at a very high speed. Such articles dissipate their kinetic energy on impact against the stop or stops 6. Any rebounding of articles which impact against the stop or stops 6 is compensated for by the pivotable orientation correcting member 26 which strikes against the rear end faces of the articles and causes each engaged article to return into full engagement with each stop 6 before the article descends in response to simultaneous lowering of the sections 4*a* to 4*e* to the positions shown in FIGS. 4 and 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating a series of flat articles, such as closely adjacent flexible stacks of paper sheets, comprising a feeding unit including first conveyor means for advancing the articles of said series in a first direction and along a first path; a removing unit including second conveyor means for advancing successive articles of said series in a second direction and along a second path located at a level below said first path; and means for transferring successive articles of said series from said first into said second path, including a table having a succession of sections disposed one behind the other, as considered in said second direction, and movable between upper positions in which they are located at the level of said first path and support from below an article supplied by said feeding unit and lower positions in which the article thereon is located at the level of said second path, means for moving said sections including means for simultaneously lowering said sections from said first to said second positions and for individually lifting the sections of said succession from said lower positions to said upper positions as soon as an article which is supported by said sections during movement to said lower positions is advanced along said second path beyond a section, and means for temporarily supporting portions of successive articles in said first path during advancement of such articles into the range of said sections, said moving means further comprising discrete sensors, one for each of said sections and each arranged to generate signals denoting the presence or absence of an article on top of the respective section, said lifting means including devices which are actuatable in response to signals from said sensors to move a section back to the upper position when the signal from the respective sensor indicates that the article which has been lowered by said sections is advanced beyond the corresponding section.

2. The apparatus of claim 1, further comprising means for disengaging said supporting means from an article in said first path not later than during simultaneous movement of said sections to said second positions.

3. The apparatus of claim 1, further comprising means for guiding the sections of said table during movement between said upper and lower positions.

4. The apparatus of claim 1, wherein said moving means comprises a discrete cam for each of said sections.

5. The apparatus of claim 4, wherein said cams are rotary cams.

6. The apparatus of claim 1, wherein said moving means comprises a discrete motor for each of said sections.

7. The apparatus of claim 6, wherein said motors are fluid-operated motors.

8. The apparatus of claim 7, wherein said motors include pneumatic cylinder and piston units.

9. The apparatus of claim 1, wherein said removing unit further comprises means for transporting successive articles from the sections of said table into the range of said second conveyor means.

10. The apparatus of claim 9, wherein said transporting means includes a finger which is movable in said second direction.

11. The apparatus of claim 9, wherein at least some of said sections have aligned slots for said transporting means.

12. The apparatus of claim 1, wherein said second conveyor means comprises a pair of endless flexible belts having portions immediately adjacent to said table, said second path being defined by and being disposed between said belts.

13. The apparatus of claim 1, further comprising stop means provided in the region of said table to arrest successive articles supplied by said feeding unit in predetermined positions with reference to said sections.

14. The apparatus of claim 13, wherein said stop means extends transversely of said first direction.

15. The apparatus of claim 13, further comprising mobile orientation correcting means provided adjacent to said first path and arranged to urge successive articles of said series against said stop means prior to movement of said sections to said lower positions.

16. The apparatus of claim 15, wherein said orientation correcting means comprises a member which is pivotable about a predetermined axis.

17. The apparatus of claim 16, wherein said axis is normal to said first direction.

18. The apparatus of claim 1, wherein said first and second directions make an angle at least approximating 90 degrees.

* * * * *